US008056190B2

(12) United States Patent
Hsieh

(10) Patent No.: US 8,056,190 B2
(45) Date of Patent: Nov. 15, 2011

(54) BUCKLE DEVICE HAVING STRAP ADJUSTING STRUCTURE

(76) Inventor: Chun-Teng Hsieh, Changhua Hsien (TW)

( * ) Notice: Subject to any disclaimer, the term of this patent is extended or adjusted under 35 U.S.C. 154(b) by 805 days.

(21) Appl. No.: 12/215,994

(22) Filed: Jul. 1, 2008

(65) Prior Publication Data

US 2010/0000056 A1 Jan. 7, 2010

(51) Int. Cl.
*A44B 11/10* (2006.01)

(52) U.S. Cl. ..... 24/171; 24/165; 24/115 H; 24/115 M

(58) Field of Classification Search ..... None
See application file for complete search history.

(56) References Cited

U.S. PATENT DOCUMENTS

| | | | | | |
|---|---|---|---|---|---|
| 441,848 | A * | 12/1890 | Kemp | 54/34 |
| 925,694 | A * | 6/1909 | Greenwood | 24/17 A |
| 2,890,534 | A * | 6/1959 | Quayle | 40/303 |
| 3,152,374 | A * | 10/1964 | Round | 24/194 |
| 3,191,253 | A * | 6/1965 | Stevenson | 24/316 |
| 3,255,502 | A * | 6/1966 | Hollins | 24/191 |
| 4,073,317 | A * | 2/1978 | Ellis | 138/147 |
| 5,383,257 | A * | 1/1995 | Krauss | 24/625 |
| 5,579,563 | A * | 12/1996 | Sim | 24/587.12 |
| 6,237,826 | B1 | 5/2001 | Gould | 224/660 |
| 6,363,590 | B1 | 4/2002 | Lan | 24/614 |
| 6,446,849 | B1 | 9/2002 | Schleifer | 224/258 |
| 6,978,520 | B2 * | 12/2005 | Falany | 24/171 |

* cited by examiner

*Primary Examiner* — Jack W. Lavinder
(74) *Attorney, Agent, or Firm* — Charles E. Baxley

(57) ABSTRACT

A buckle device includes a female member having a chamber for receiving a strap, a male member having two tabs for engaging into the chamber of the female member and for detachably coupling the female member and the male member together, and a pressing device engaged into the chamber of the female member and having one end pivotally coupled to the female member with a pivot axle, and having the other end for engaging with the strap and for limiting the strap to move relative to the female member, and the tabs of the male member are engageable with the pressing device for forcing the pressing device to engage with the strap when the tabs of the male member are engaged into the chamber of the female member.

11 Claims, 6 Drawing Sheets

BUCKLE DEVICE HAVING STRAP ADJUSTING STRUCTURE

BACKGROUND OF THE INVENTION

1. Field of the Invention

The present invention relates to a buckle device, and more particularly to a buckle device including a structure for allowing the strap to be easily and quickly adjusted relative to the buckle device and for allowing the strap to be easily and quickly attached onto the cargo or objects.

2. Description of the Prior Art

Typical buckle devices comprise a male member and a female member detachably coupled together, and each including an aperture formed therein for strapping or engaging with a belt and for detachably coupling or attaching the buckle devices onto a user or a cargo or objects.

For example, U.S. Pat. No. 6,237,826 to Gould, U.S. Pat. No. 6,363,590 to Lan, and U.S. Pat. No. 6,446,849 to Schleifer disclose three of the typical buckle devices each comprising a male member and a female member detachably fastened together, and the female member including a chamber for receiving the male member, and a belt or a strap coupled to the male member and the female member with frictional snubbing devices and for allowing the belt to be adjustably coupled or attached onto the user or the cargo or the objects.

However, the typical buckle devices include only an aperture formed therein for strapping or receiving the belt or the strap, but have no engaging means or device for engaging with the belt or the strap such that the belt or the strap may not be frictionally attached to the typical buckle devices and may not be adjusted relative to the buckle devices.

The present invention has arisen to mitigate and/or obviate the afore-described disadvantages of the conventional belt buckle devices.

SUMMARY OF THE INVENTION

The primary objective of the present invention is to provide a buckle device including a structure for allowing the strap to be easily and quickly adjusted relative to the buckle device and for allowing the strap to be easily and quickly attached onto the user or cargo or objects.

In accordance with one aspect of the invention, there is provided a buckle device comprising a female member including a chamber formed therein, and including a first end and a second end, a strap engaged through the chamber of the female member, a male member including two tabs extended therefrom for engaging into the chamber of the female member and for detachably coupling the female member and the male member together, and a pressing device engaged into the chamber of the female member and including a first end pivotally coupled to the female member with a pivot axle, and including a second end for engaging with the strap and for limiting the strap to move relative to the female member, and the tabs of the male member is engageable with the pressing device for forcing the pressing device to engage with the strap when the tabs of the male member are engaged into the chamber of the female member and for allowing the strap to be easily and quickly attached onto the user or cargo or objects.

The pressing device includes a plurality of teeth provided on the second end thereof for frictionally engaging with the strap. The pressing device includes a tubular member provided on the first end thereof for receiving or engaging with the pivot axle and for rotatably or pivotally coupling the pressing device to the female member.

The pressing device includes an extension extended therefrom for engaging with the female member and for forcing or pressing the second end of the pressing device to engage with the strap. The extension is extended from the first end of the pressing device. The female member includes an upper wall, and the extension of the pressing device is engageable with the upper wall of the female member.

The female member includes two side walls each having an opening formed therein for aligning with the tabs of the male member when the tabs of the male member are engaged into the chamber of the female member. The female member includes two spring blades extended into the openings of the female member and aligned with the tabs of the male member for being depressed by a user.

The strap includes a first end coupled to the male member. The first end of the pressing device may be pivotally coupled to either the first end or the second end of the female member with the pivot axle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
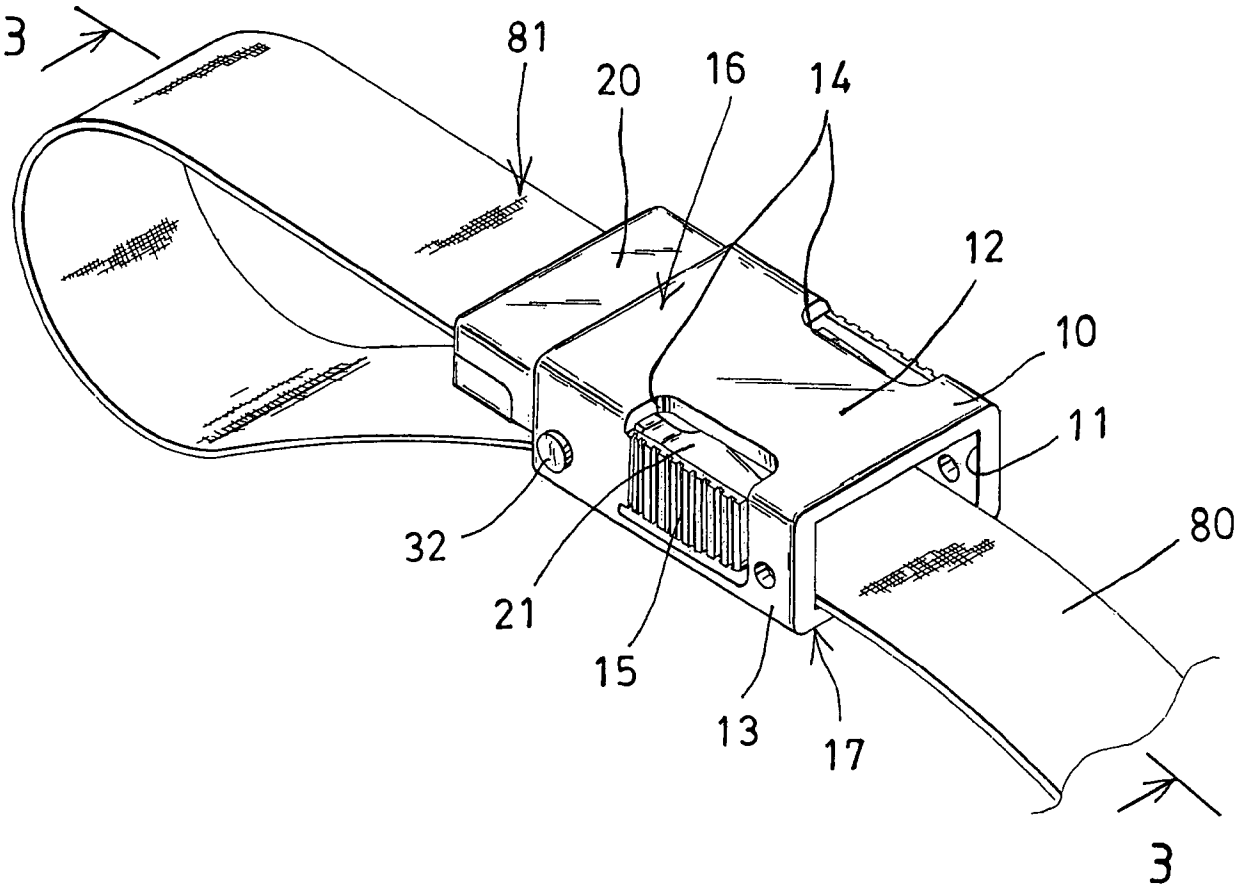
FIG. 1 is a partial perspective view of a buckle device in accordance with the present invention.
Figure 2:
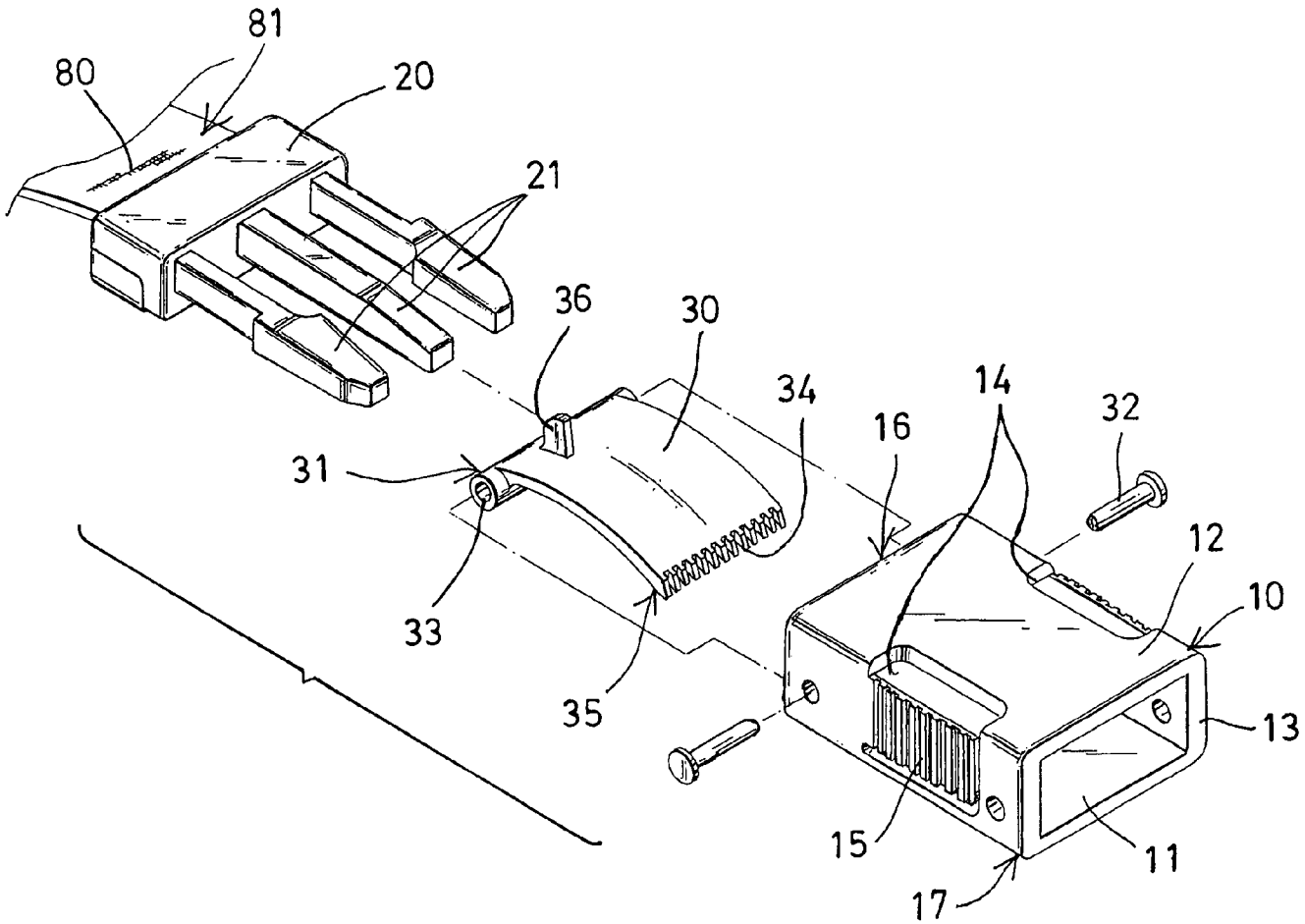
FIG. 2 is an exploded view of the buckle device.
Figure 3:
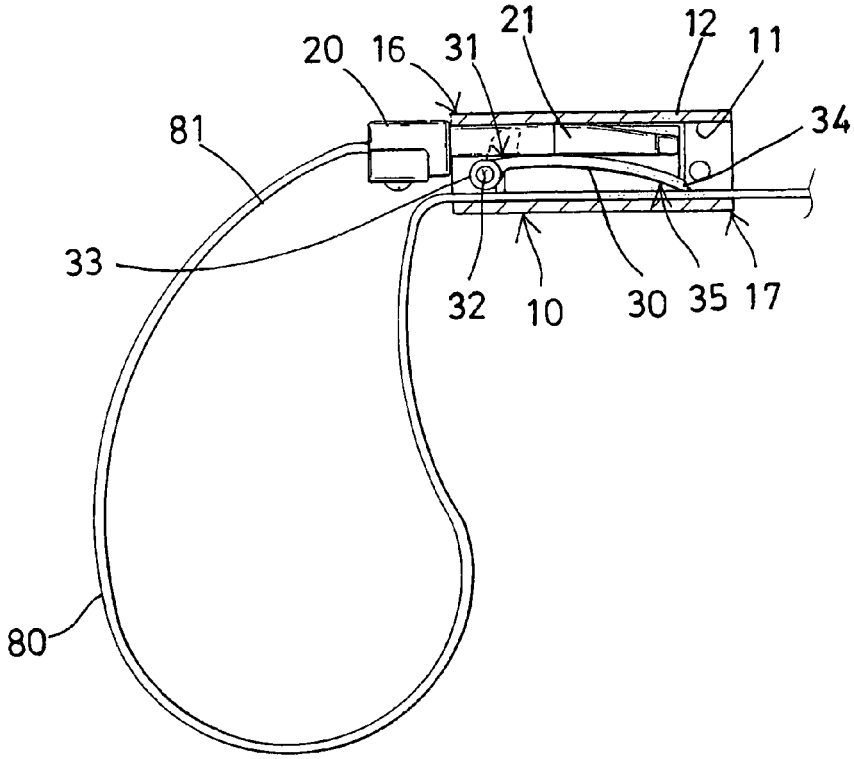
FIG. 3 is a cross sectional view of the buckle device taken along lines 3-3 of FIG. 1.

Referring to the drawings, and initially to FIGS. 1-3, a buckle device in accordance with the present invention comprises a female member 10 including a chamber 11 formed therein and formed or defined by an upper wall 12 and two side walls 13, and including a notch or opening 14 formed in each of the side walls 13, and/or partially formed in the upper wall 12, and including a spring blade 15 extended into each of the openings 14 for being depressed by the user. A male member 20 includes two or more catches or tongues or tabs 21 extended therefrom for engaging into the chamber 11 of the female member 10 and for aligning with the openings 14 of the female member 10 and for detachably coupling the female member 10 and the male member 20 together.

A belt or strap 80 includes one end 81 coupled to the male member 20 for coupling or attaching onto the users or the cargo or the objects (not shown). The spring blade 15 of the female member 10 are aligned with the tabs 21 of the male member 20 (FIG. 1) for allowing the tabs 21 of the male member 20 to be depressed with the spring blade 15 of the female member 10 by the user for allowing the tabs 21 of the male member 20 to be detached or disengaged from the female member 10 when the spring blades 15 are depressed by the user. Alternatively, without the spring blades 15, the tabs 21 of the male member 20 may also be directly depressed by the user. The above-described structure is typical and will not be described in further details.

The buckle device in accordance with the present invention further comprises a pawl or pressing device 30 engaged into the chamber 11 of the female member 10, and the pressing device 30 includes one end or first end 31 rotatably or pivotally attached or secured or coupled to the one end or first end 16 of the female member 10 with a pivot axle 32, for example, the pressing device 30 includes a tubular member 33 formed or provided on the first end 31 for receiving or engaging with the pivot axle 32 and for pivotally attaching or coupling the pressing device 30 in the chamber 11 of the female member 10. The other portion of the strap 80 may be engaged through the chamber 11 of the female member 10 from the one end or first end 16 of the female member 10 toward the other end or second end 17 of the female member 10 for engaging with the pressing device 30 (FIGS. 3, 4).

For example, the pressing device 30 includes a number of projections or teeth 34 formed or provided on the other or second end 35 thereof for engaging with the strap 80 and for limiting the strap 80 to move relative to the female member 10 and for allowing the strap 80 to be pulled or moved in the direction from the one end or first end 16 of the female member 10 toward the other end or second end 17 of the female member 10 (FIG. 5), and for preventing the strap 80 from being pulled or moved in the other or opposite direction from the other end or second end 17 of the female member 10 toward the one end or first end 16 of the female member 10, and thus for allowing the strap 80 to be pulled or moved unidirectionally relative to the female member 10 only, and thus for allowing the strap 80 to be easily and quickly adjusted relative to the female member 10.

Figure 4:
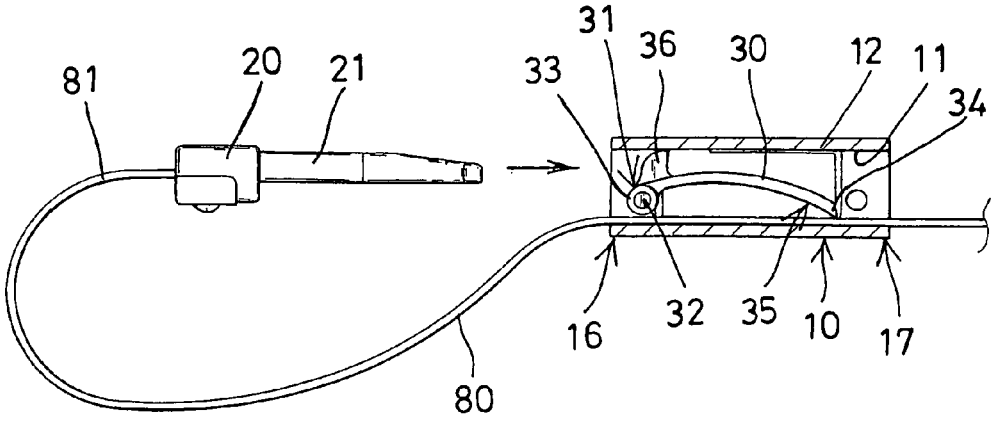
FIG. 4 is a cross sectional view similar to FIG. 3, illustrating the operation of the buckle device.
Figure 6:
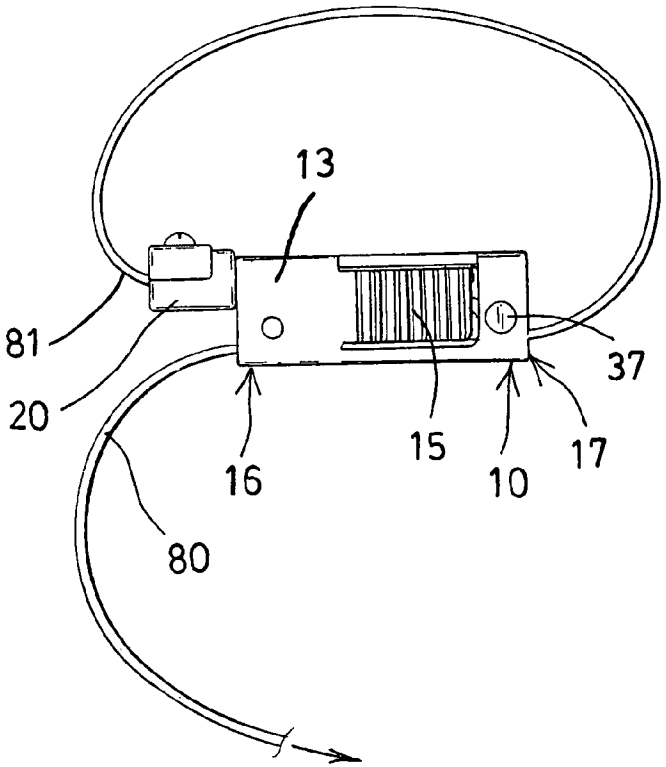
FIG. 6 is a side plan schematic view similar to FIG. 5, illustrating the other arrangement of the buckle device.
Figure 5:
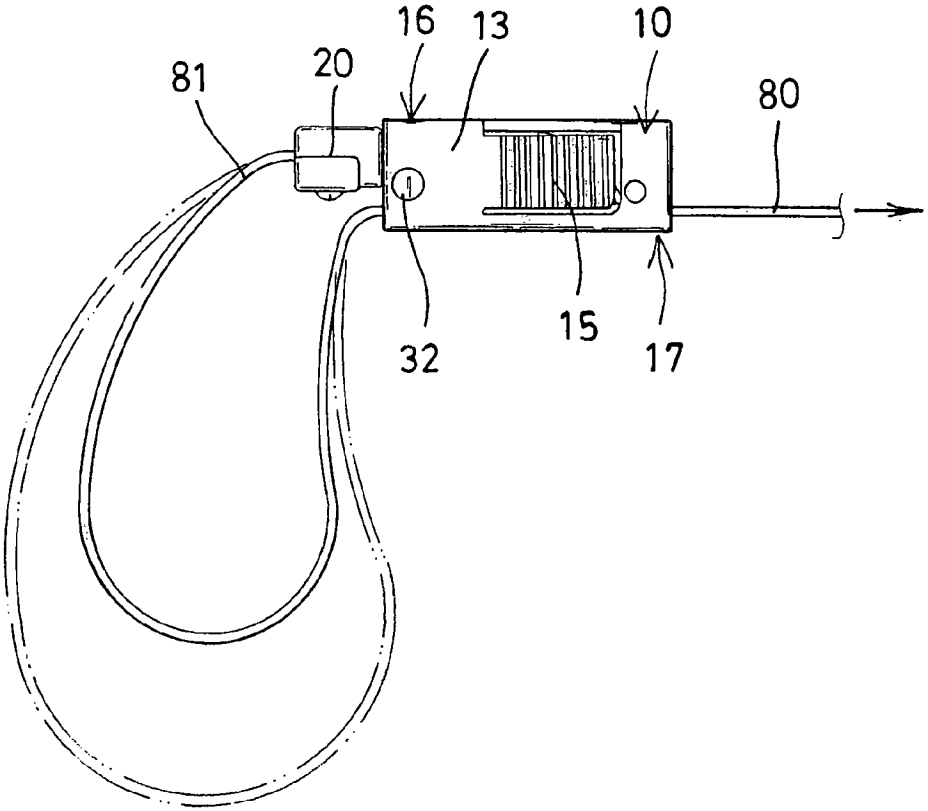
FIG. 5 is a side plan schematic view illustrating the operation of the buckle device.
Figure 7:
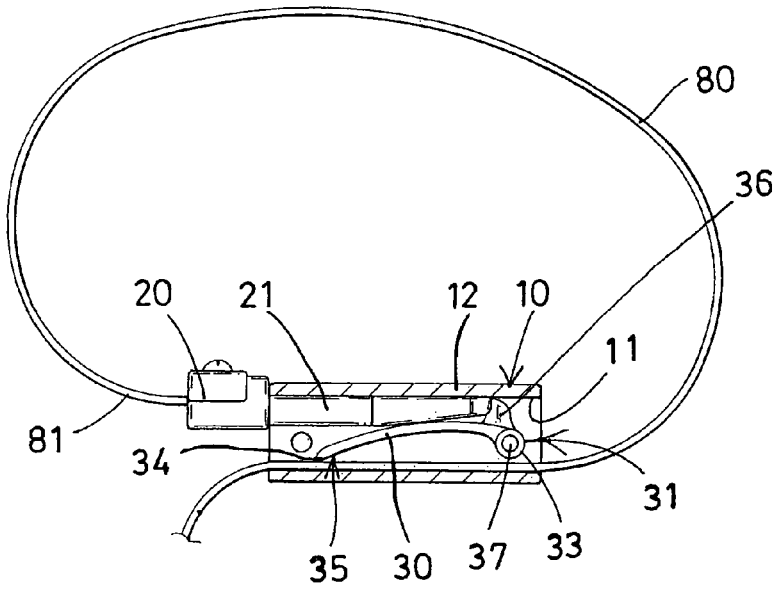
FIG. 7 is a cross sectional view of the buckle device as shown in FIG. 6.
Figure 8:
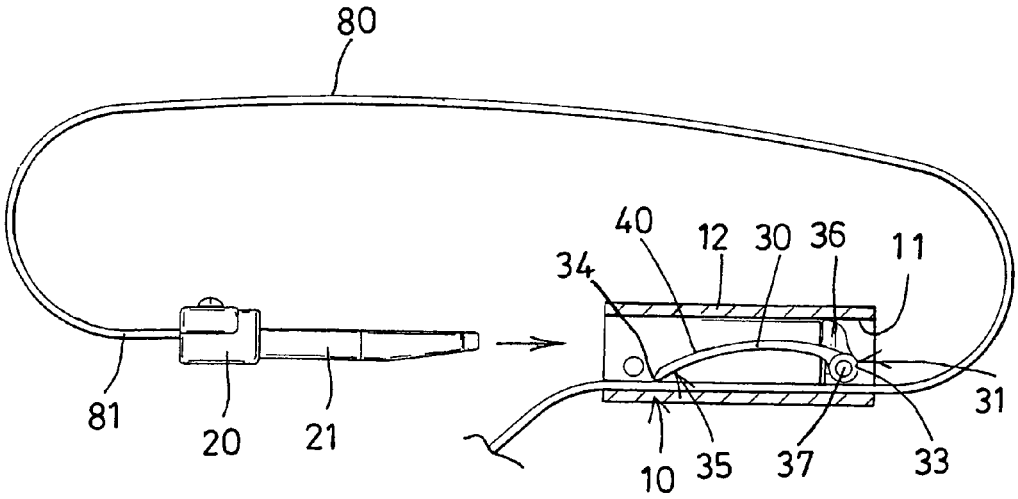
FIG. 8 is a cross sectional view similar to FIG. 7, illustrating the operation of the buckle device as shown in FIGS. 6-7.
Figure 9:
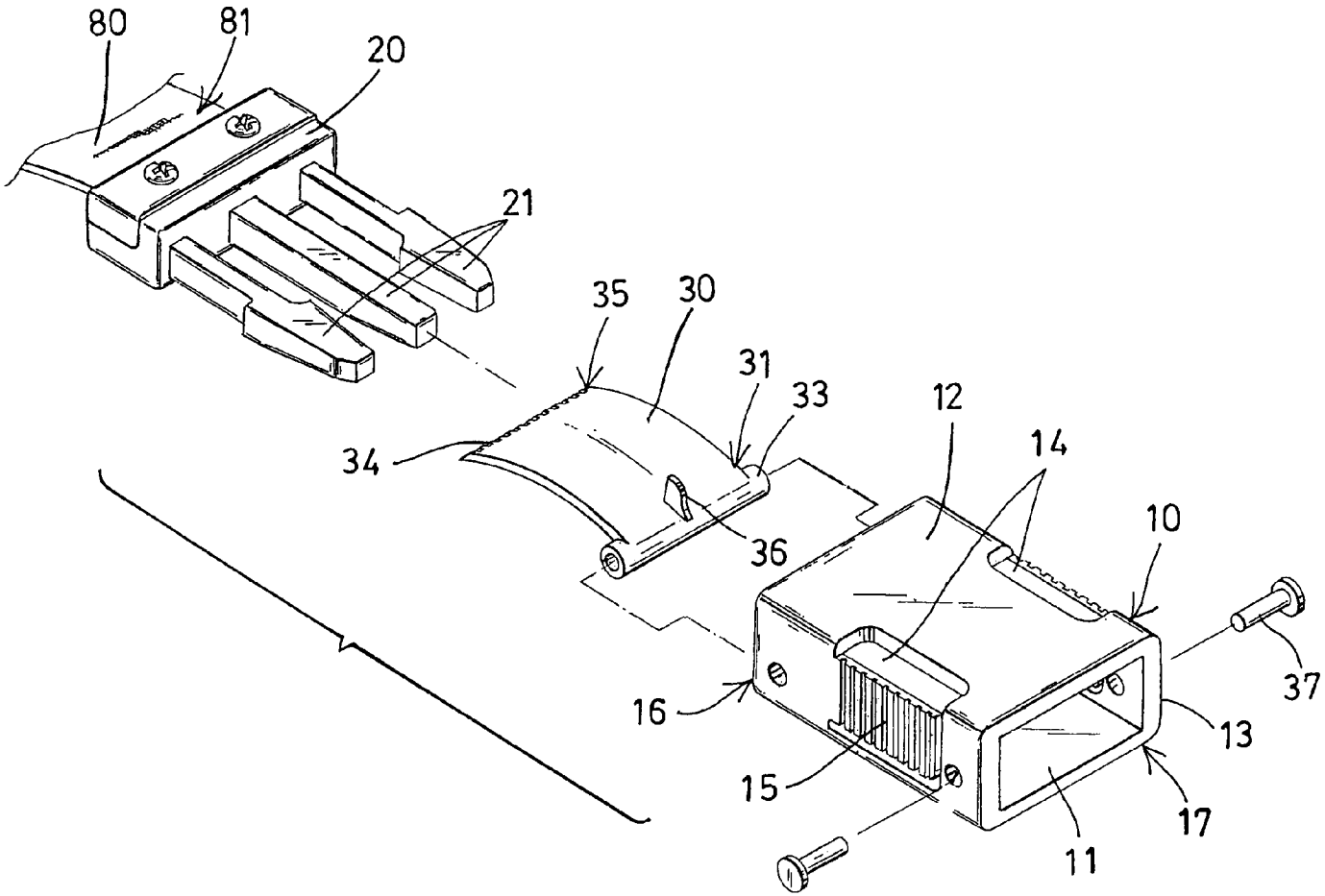
FIG. 9 is an exploded view of the buckle device as shown in FIGS. 6-8.

In operation, as shown in FIGS. 3-5, the tabs 21 of the male member 20 may be engaged into the chamber 11 of the female member 10 and may be engaged with the pressing device 30 for forcing or pressing the teeth 34 of the pressing device 30 to engage with the strap 80 and to limit the strap 80 to move relative to the female member 10 unidirectionally, and thus for allowing the strap 80 to be easily and quickly adjusted relative to the female member 10 and to be easily and quickly attached onto the cargo or objects. It is preferable that the pressing device 30 further includes a cam or extension 36 extended therefrom, such as extended from the first end 31 thereof for engaging with the upper wall 12 of the female member 10 and for forcing or pressing the teeth 34 of the pressing device 30 to engage with the strap 80 when the tabs 21 of the male member 20 are detached or disengaged from the female member 10 (FIG. 4).

Alternatively, as shown in FIGS. 6-9, the pressing device 30 may be disposed in the opposite or different direction from that shown in FIGS. 1-5, and may have the first end 31 or the tubular member 33 pivotally attached or secured or coupled to the other end or second end 17 of the female member 10 with a pivot shaft 37, and may have the other or second end 35 of the pressing device 30 disposed or extended or provided in the one end or first end 16 of the female member 10, and the other portion of the strap 80 may be engaged through the chamber 11 of the female member 10 from the other end or second end 17 toward the one end or first end 16 of the female member 10.

The teeth 34 of the pressing device 30 may also be forced to depress the strap 80 and to limit the strap 80 to move relative to the female member 10 and for allowing the strap 80 to be pulled or moved in the direction from the other end or second end 17 toward the one end or first end 16 of the female member 10, and for preventing the strap 80 from being pulled or moved in the other or opposite direction from the one end or first end 16 toward the other end or second end 17 of the female member 10, and thus for allowing the strap 80 to be pulled or moved unidirectionally relative to the female member 10 only, and for preventing the strap 80 from being pulled or moved in the other or opposite direction, and thus for allowing the strap 80 to be easily and quickly adjusted relative to the female member 10.

Accordingly, the buckle device in accordance with the present invention includes a structure for allowing the strap to be easily and quickly adjusted relative to the buckle device and for allowing the strap to be easily and quickly attached onto the user or cargo or objects.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A buckle device comprising:

a female member including a chamber formed therein, and including a first end and a second end, a strap engaged through said chamber of said female member, a male member including two tabs extended therefrom for engaging into said chamber of said female member and for detachably coupling said female member and said male member together, and a pressing device engaged into said chamber of said female member and including a first end pivotally coupled to said female member with a pivot axle, and including a second end for engaging with said strap and for limiting said strap to move relative to said female member, and said tabs of said male member being engageable with said pressing device for forcing said pressing device to engage with said strap when said tabs of said male member are engaged into said chamber of said female member.

2. The buckle device as claimed in claim 1, wherein said pressing device includes a plurality of teeth provided on said second end thereof for engaging with said strap.

3. The buckle device as claimed in claim 1, wherein said pressing device includes a tubular member provided on said first end thereof for engaging with said pivot axle.

4. The buckle device as claimed in claim 1, wherein said pressing device includes an extension extended therefrom for engaging with said female member and for forcing said second end of said pressing device to engage with said strap.

5. The buckle device as claimed in claim 4, wherein said extension is extended from said first end of said pressing device.

6. The buckle device as claimed in claim 4, wherein said female member includes an upper wall, and said extension of said pressing device is engageable with said upper wall of said female member.

7. The buckle device as claimed in claim 1, wherein said female member includes two side walls each having an opening formed therein for aligning with said tabs of said male member when said tabs of said male member are engaged into said chamber of said female member.

8. The buckle device as claimed in claim 7, wherein said female member includes two spring blades extended into said openings of said female member and aligned with said tabs of said male member for being depressed by a user.

9. The buckle device as claimed in claim 1, wherein said strap includes a first end coupled to said male member.

10. The buckle device as claimed in claim 1, wherein said first end of said pressing device is pivotally coupled to said first end of said female member with said pivot axle.

11. The buckle device as claimed in claim 1, wherein said first end of said pressing device is pivotally coupled to said second end of said female member with a pivot shaft.

* * * * *